United States Patent [19]

Frezza

[11] 3,941,326

[45] Mar. 2, 1976

[54] APPARATUS FOR FABRIC WEB TREATMENT

[75] Inventor: Robert Frezza, Carle Place, N.Y.

[73] Assignee: Samcoe Holding Corporation, Woodside, N.Y.

[22] Filed: Aug. 5, 1974

[21] Appl. No.: 494,517

Related U.S. Application Data

[63] Continuation-in-part of Ser. No. 348,068, April 5, 1973.

[52] U.S. Cl. ..... 242/56 R

[51] Int. Cl.[2] ..... B65H 19/20; B65H 17/08

[58] Field of Search ..... 242/56 R, 56 A, 66

[56] References Cited

UNITED STATES PATENTS

| | | | |
|---|---|---|---|
| 2,682,379 | 6/1954 | Piper et al. | 242/56 R |
| 3,009,376 | 11/1961 | Rose et al. | 242/56 R |
| 3,556,424 | 1/1971 | Catallo | 242/56 R |
| 3,567,144 | 3/1971 | Dambroth | 242/56 R |
| 3,606,186 | 9/1971 | Cohn et al. | 242/66 X |
| 3,633,840 | 1/1972 | Clark | 242/56 R |
| 3,721,396 | 3/1973 | Morizzo | 242/56 R |
| 3,845,914 | 11/1974 | Straujups | 242/56 R |

*Primary Examiner*—Leonard D. Christian
*Attorney, Agent, or Firm*—Mandeville and Schweitzer

[57] ABSTRACT

The invention relates to methods for increasing the production over a given period of time of the finishing of tubular knitted fabric and to the semi-automatic control of the batching and doffing thereof.

Included herewith are methods for enhancing the speed of steam treatment of such fabrics by increasing impregnation thereof with steam boxes enclosed in a steam chamber, and methods for limiting roll pressure during stretching of the fabric to reduce marking.

Also included is a semi-automatic batching and doffing device incorporating controls for sequentially inserting an empty mandrel, cutting, and positively controlling the cut loose end of fabric web for engagement with the new mandrel, with such sequence being initiated by removal of the previous wound-up roll. The cutter and the air jet control for the cut loose end of fabric are movable into and out of engagement with the web path of movement for enhancing the positioning thereof for action upon the web.

6 Claims, 9 Drawing Figures

2
2
10
11
12
17
18
19
20
21
21a
22
23
24
25
26
27
28
29
29a
30
31
32
33
37

21
17
10
17
29a
29a
30
37
28
29
29
12
25
23
32
24
22
35a
31
31
26
27
34
36
35
36

PR

APPARATUS FOR FABRIC WEB TREATMENT

BACKGROUND AND SUMMARY OF THE INVENTION

This application is a continuation-in-part of copending application Ser. No. 348,068, filed Apr. 5, 1973.

In the processing and finishing treatment of tubular knitted fabric, it is conventional practice to direct the tubular fabric over an internal spreading device. This distends the fabric laterally to a predetermined uniform width. While the fabric is held in this condition, it is steamed to relax the fibers and enable the fabric to readjust to a laterally distended, geometrically uniform condition. The fabric then tends to retain this condition as it is delivered off the spreading device. The thus treated fabric may then be passed between a pair of calender rolls, and subseqeuntly gathered in a convenient manner, as by folding or gathering into a roll.

In general, the procedures outlined in the foregoing paragraph are well known. The present invention thus is not directed to the finishing procedure in a general sense, but is directed to more specific structural and procedural aspects calculated to achieve increased production rates along with a superior quality of production.

The processing system of the invention includes a motordriven, substantially tension-free feeding system for delivering tubular knitted fabric to the upstream or the entry end of the spreader frame. By providing greater uniformity of conditions in the fabric directed onto the spreader frame, improved uniformity in the processed fabric delivered therefrom is achieved.

At the discharge end, the system of the invention may include a folder or roll-up batcher. In part, the invention relates to an improved form of roll-up batcher, which minimizes the shutdown or slowdown intervals when a completed roll is removed and a new roll is started. The roll-up batcher mechanism of the invention provides an increased degree of automation in the cutoff and restarting cycles. The arrangement is such that an operator, stationed at the discharge end of the machine, need merely initiate a roll removal operation, after which fabric cutoff and the restarting of another batch roll takes place rapidly and without further operator intervention. This has desirable safety aspects, as well as providing for higher production by shortening the change-over interval.

RELATED APPLICATIONS

An integral part of the present method for achieving higher production rates without compromising quality, is an improved steaming arrangement for applying steam to the laterally distended tubular knitted fabric as it passes over the spreader frame. The specific structural features of this steamer, by itself, form the subject matter of my related copending application Ser. No. 355,401, filed Apr. 30, 1973, entitled "High Production Steamer."

For a better understanding of the above and other features of the invention, reference should be made to the following detailed description and to the accompanying drawings.

DESCRIPTION OF A PREFERRED EMBODIMENT

Figure 1A:
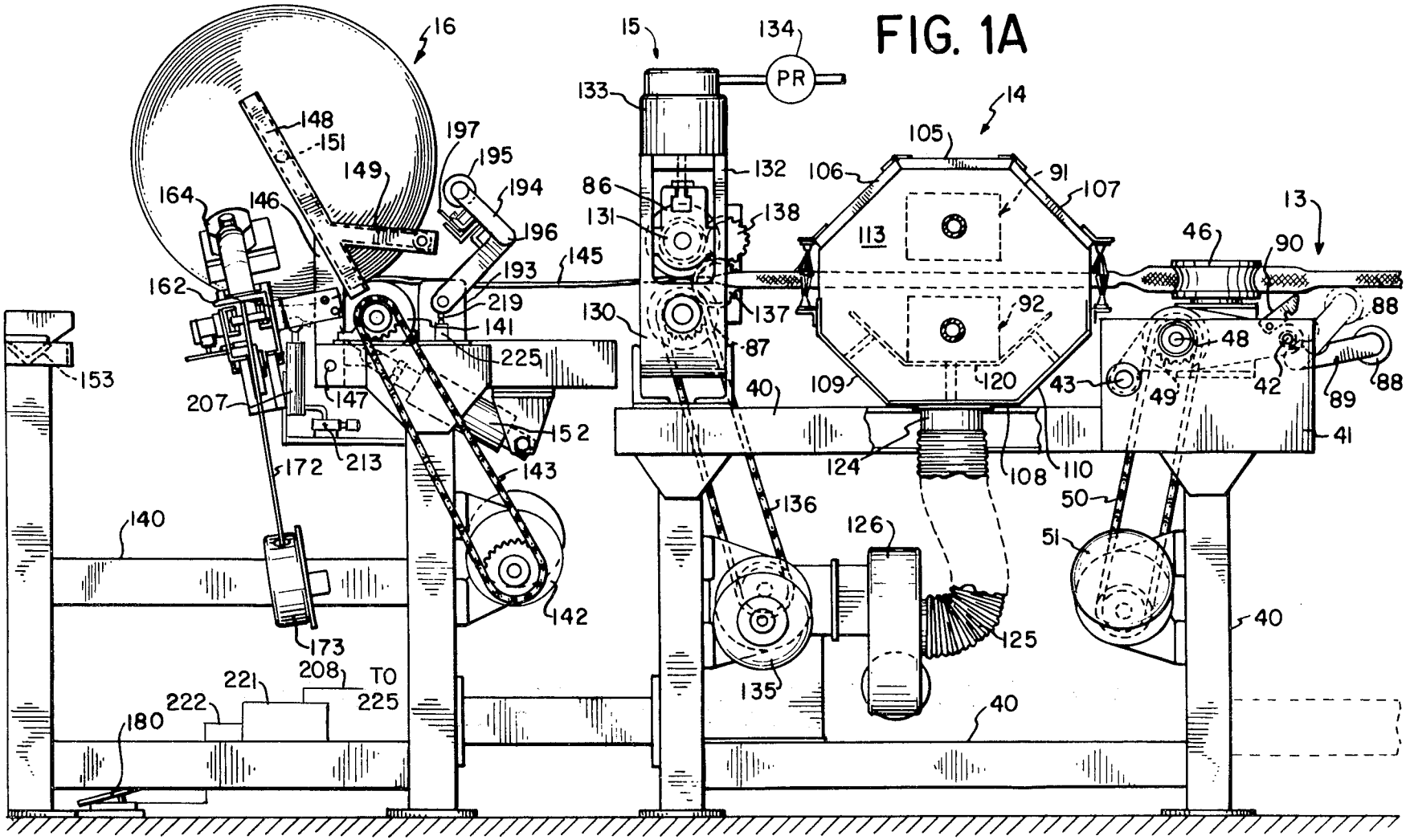
FIGS. 1A and 1B, taken together, constitute a side elevational view of apparatus embodying and for practicing the invention.
Figure 1B:
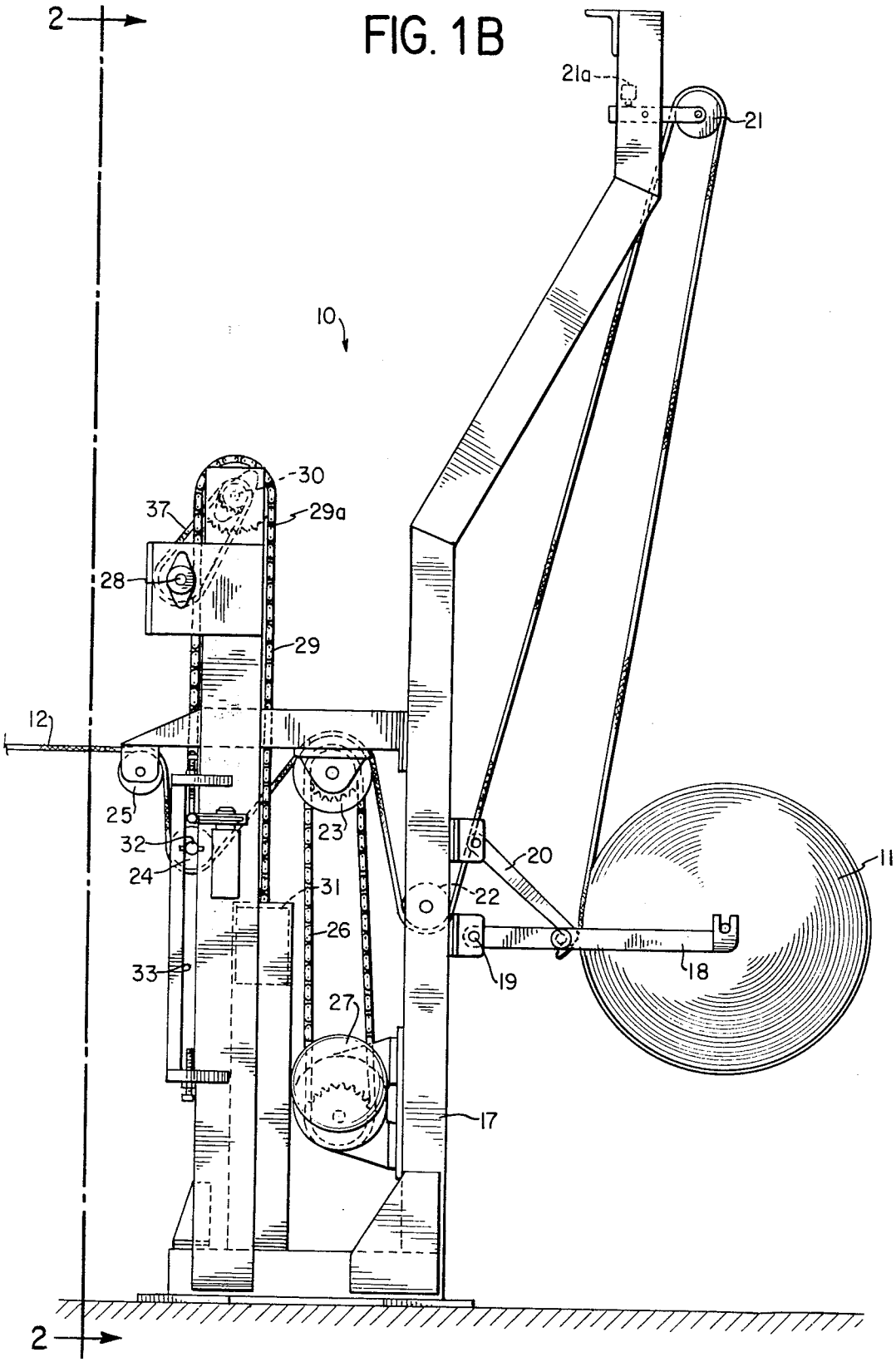

Referring now to the drawings and initially to FIGS. 1A–1B, the reference numeral 10 applies generally to a fabricfeeding stage, which supports a supply 11 of unfinished, tubular knitted fabric 12. In the illustration, the supply 11 is in the form of a roll, although it could as well be a truck or other supply container. The fabric 12 is delivered by the supply section to a spreading or distending section 13, where the fabric is initially distended to a predetermined uniform width and arranged in a flat, two-layered form. The fabric then passes through a steaming section 14, while still in its distended condition, and it is there subjected to the action of jets of steam to warm and moisten the fibers of the fabric.

In the illustrated system, the fabric being discharged from the spreading section 13 passes through a calendering section 15 comprising essentially a pair of nip rolls, which may be in pressure-bearing relation or not, depending on the desired finishing procedure. The thus-finished fabric advances to a gathering section 16, where it is accumulated in a convenient manner and in batches of convenient size and weight. In the illustrated arrangement, the gathering section comprises a roll-up batcher, arranged to collect the fabric in the form of a roll, and to sever the fabric and deliver a roll of finished material of predetermined length or weight and of uniform width.

Referring more particularly to FIG. 1B, the supply section 10 of the apparatus includes an appropriate frame structure 17 arranged to rotatably support a supply roll 11 by means of arms 18. The arms 18, which normally are supported in operative positions by latch arms 20, are arranged to be folded in close to the frame 17, about pivots 19, to accommodate other forms of fabric supplies, such as containers.

Supply fabric 12 leaving the roll 11 advantageously is first directed upwardly about an idler roll 21, and then downwardly underneath and around a second idler roller 22. This provides a broad expanse of cloth conveniently accessible for visual inspection by the machine operator.

In the illustrated system, the supply fabric 12, after passing the idler roller 22, is guided over and around a driven feed roller 23. In accordance with well known principles, the feed roller 23 may be provided with a high friction surface so as to have a suitable frictional engagement on the fabric surface. After passing around the feed roller, the fabric travels downwardly, under and around a floating control roller 24 and thence upwardly and around an idler roll 25. As will be observed, the geometric relationship of the several rollers 22-24 provides for the fabric to be in contact with the feed roller 23 over a substantial arc of its circumference for good feeding contact.

In the illustrated apparatus, the feed roller 23 is driven by a chain 26 from a variable speed electric motor 27. The operating speed of the motor 27 is controlled by a rotary control device 28, which senses the vertical position of the floating roller 24 to effect an increase in motor speed, as the floating roller tends to rise, and to effect a slowdown of the motor if the floating roller tends to move to a lower position. This provides a constantly modulating speed control over the infeeding of the fabric.

Figure 2:
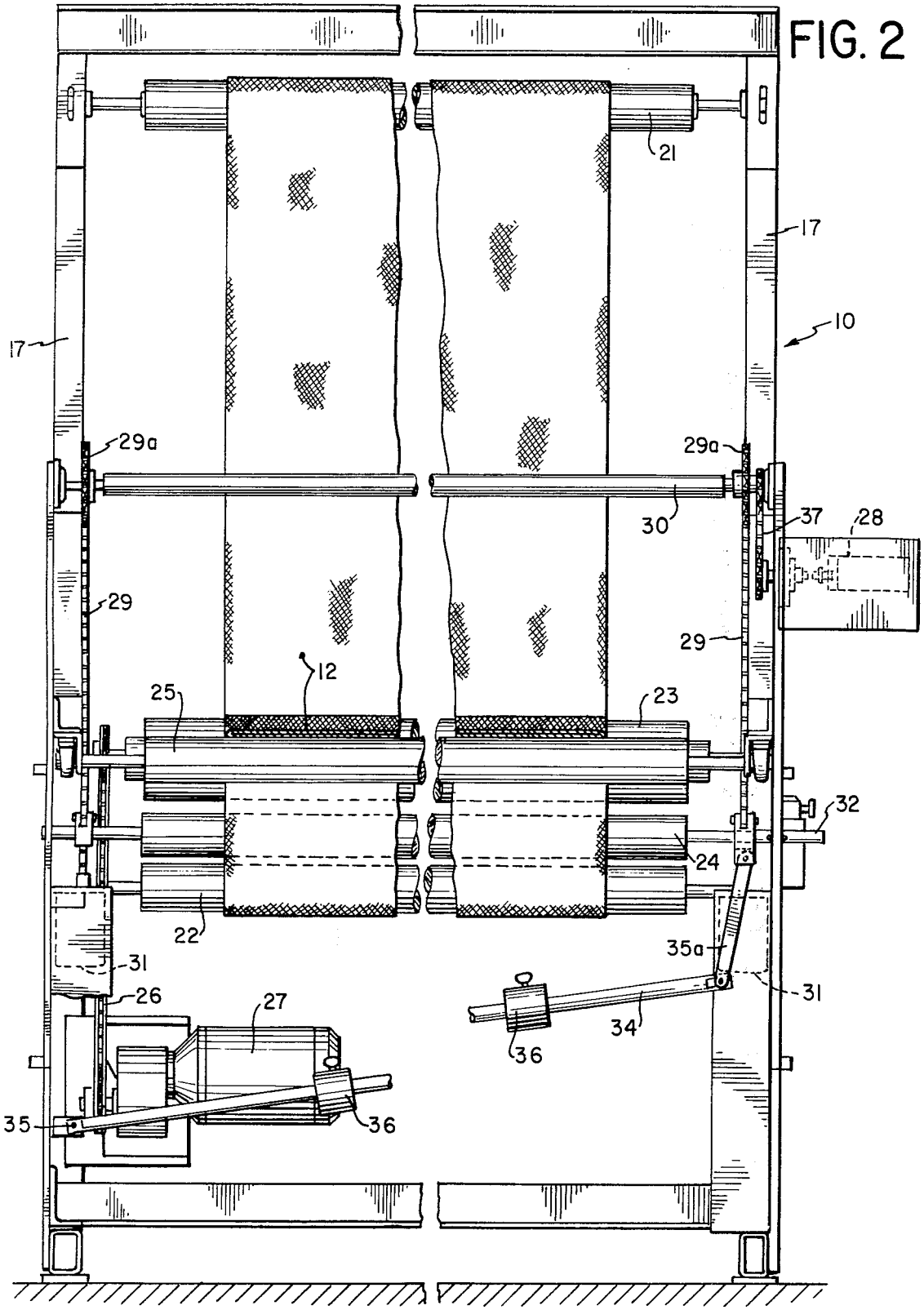
FIG. 2 is a back elevational view of a fabric infeed stand utilized in the apparatus of FIG. 1A–1B, as viewed generally at line 2—2 of FIG. 1B.

With reference to FIG. 2, the floating roller 24 is shown to be supported at its opposite end by chains 29 trained over sprockets 29*a* affixed to opposite ends of an equalizer shaft 30. The chains 29 also support counterweights 31, which are intended to provide a substantially neutral counterbalance to the entire floating roll mechanism. The end extremities of the shaft 32 of the floating roll are guided in a vertical slot 33 (FIG. 1B) which confines the movement of the floating roll and guides it in a vertical plane.

To provide a controlled downward weight bias on the floating roll 24, a rod 34 is pivoted at 35, at one side of the supply stand, and is connected at the other end to one side of the floating roll shaft 32 by means of a pivoted connecting link 35*a*. The rod 34 carries one or more slideably adjustable control weights 36, which may be moved toward and away from the pivot point 35 to adjust the effective weight applied to the floating roll. In this connection, although the adjustable weight is applied at one side only, its effect is balanced because of the equalizer shaft 30. A suitable chain and sprocket arrangement, generally designated by the numeral 37, connects the equalizer shaft 30 to the rotary control device 28, so that a positive relationship is maintained between the vertical position of the floating roll and the rotary position of the control device 28. The rotary control device does not significantly alter the forces balancing the floating control roller 24, so that the fabric supplied from the feeding device of FIG. 1B is at all times under a substantially uniform tension, which is maintained at the lowest practicable amount.

Suitable limit switch means (not shown) may be provided to shut down the entire line in the event that the floating roller 24 would move to either the upper or lower limit of travel provided by the slot 33, reflecting a malfunction of the system at some stage. In addition, it is desirable to support the initial idler roll 21 to accommodate a limited downward movement in response to excessive tension in the fabric leading from the supply. Such movement is utilized to trip a safety switch 21a, to shut down the entire line.

Figures 3, 4, 5:
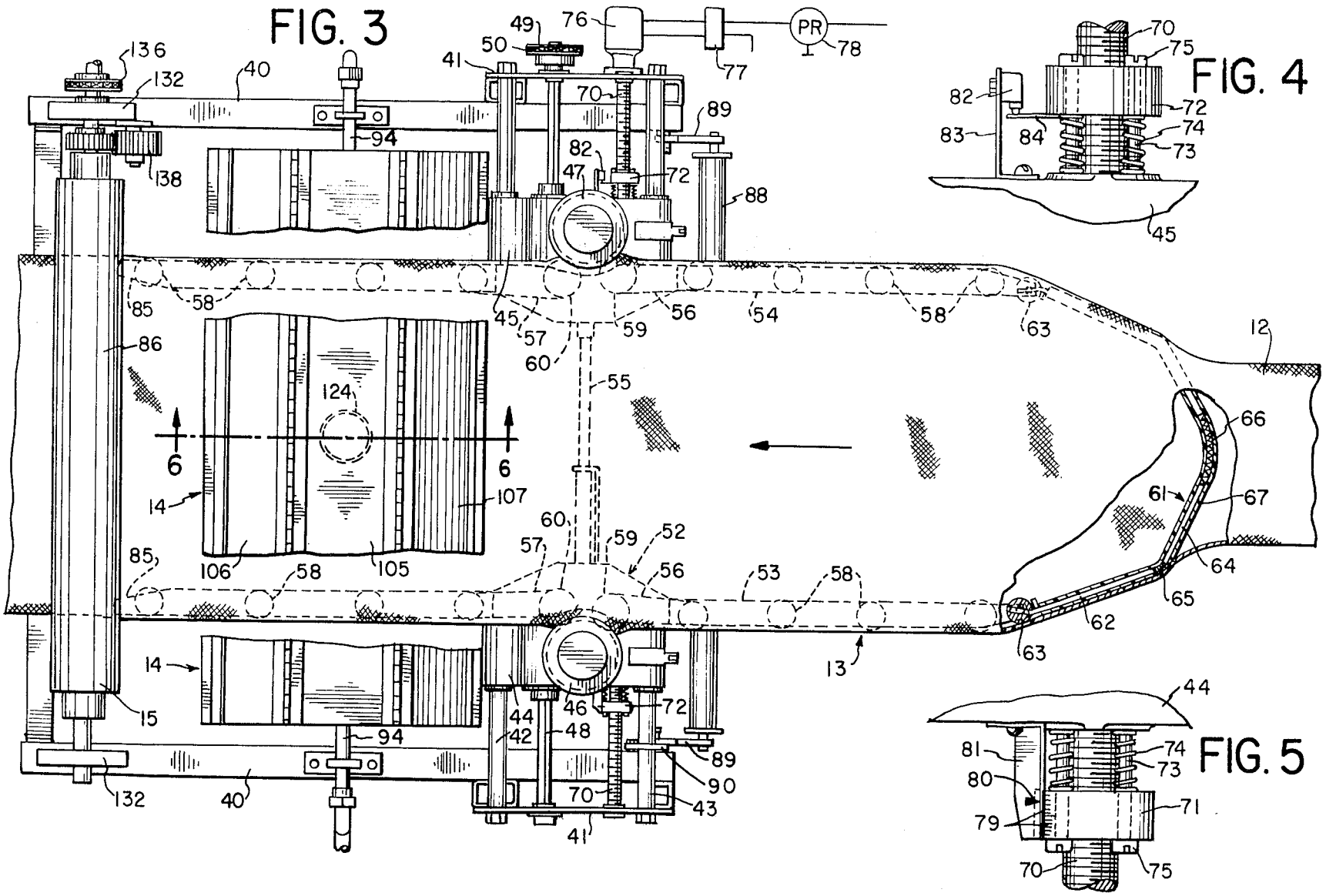
FIG. 3 is a top plan view of a portion of the apparatus of FIGS. 1A and 1B, illustrating details of the spreader frame and edge drive arrangements therefor.
FIGS. 4 and 5 are enlarged, fragmentary top plan views illustrating details of edge drive pressure control means utilized in the apparatus of the invention.

Referring now to FIGS. 1A and 3, the numeral 40 designates a frame structure for the processing section which supports the edge drive rolls, the steamer and the calender rolls. At the upstream or entry side of frame 40 there are provided brackets 41, which support a pair of guide rods 42, 43 extending transversely across the machine frame. The guide rods support a pair of edge drive roll carriages 44, 45, on which are supported, for rotation about vertical axes, a pair of edge drive rolls 46, 47.

A square or splined shaft 48 is journalled in the brackets 41, extends through the carriages 44, 45, and mounts a sprocket 49 at one end. The square shaft 48 is driven by a chain 50 from an adjustable speed motor 51. The speed of the motor 51 is controlled by the machine operator, using conventional controls (not specifically illustrated) such that adjusted speed of the edge drive rolls constitutes the basic machine speed of the system, and all other speed functions are appropriately related thereto. By way of example, the operational speed of the infeed station 10 automatically is related to the adjusted speed of the edge drive rolls by means of the modulating control of the floating roller 24, which continually senses the rate at which the fabric is being demanded by the edge drive rolls 46, 47.

Positioned between the edge drive rolls 46, 47 is a spreader frame designated by the reference numeral 52. This spreader frame typically includes a pair of frame sections 53, 54 extending longitudinally in spaced relation, and an adjusting bar 55, which connects the two frame sections, advantageously in the region of the edge drive rolls, and holds them at a predetermined width dictated by the fabric processing requirements.

When the equipment is to be operated as a tensionless calender (see Cohn, et al. U.S. Pat. Nos. 2,589,344 and 2,589,345, for example), the spreader frame 52 includes a pair of upstream propeller belts 56, and a pair of downstream propeller belts 57, guided by a plurality of rollers 58, so as to have longitudinally extending portions exposed at the outer edge extremities of the spreader frame for engagement with the internal edges of a length of tubular knitted fabric distended over the frame.

The respective pairs of belts 56, 57 are trained over drive pulleys 59, 60 located in the mid-region of the spreader frame. The drive pulleys are arranged to be positioned in straddling relation to the edge drive rolls 46, 47 and to contact the rolls through an interposed wall of fabric. Thus, when the edge drive rolls are rotated, by the square drive shaft 48, the respective propeller belts 56, 57 are driven by the pulleys 59, 60. By appropriate design of the pulleys 59, 60, the upstream belts 56 are caused to operate at a slightly higher rate of speed than the downstream belts 57, so that the tubular knitted fabric is slightly "overfed" onto the downstream belts. This accommodates lengthwise relaxation of the fabric.

The two-stage spreader can also be arranged to underfeed the fabric from the first to the second stage, if desired. Where the equipment is to be operated as a so-called straight line calender, the spreader frame may employ a single pair of belts arranged to convey the fabric at constant speed over the full length of the spreader.

Proper entry of the unprocessed tubular knitted fabric 12 onto the spreader frame is promoted by an entry end guide bar assembly 61. The guide bar assembly includes at each side a rod section 62 which is received in a pivotable socket 63 carried at the upstream extremity of the spreader frame. The rod sections 62 are connected to second rod sections 64 by short springs 65, which accommodate bending action between the first and second rod sections. The respective rod sections 64 are in turn connected together by a spring 66, which likewise accommodates bending action between those rod sections. The entire assembly is covered by a section of plastic tubing 67, so that the incoming fabric freely slides over the guide bar and is advanced to the propeller belt sections of the spreader frame. The described construction of the entry guide bar assembly is advantageous in that it accommodates substantial variation in the spacing of the spreader frame sections 53, 54 by the bending action of the springs 65, 66 and the pivoting movement of the sockets 63.

Transverse adjustment of the edge drive roll carriages 44, 45 is effected by means of a threaded shaft 70, which is reversely threaded at opposite ends so as to effect simultaneous and equal inward or outward movement of the respective carriages 44, 45 upon rotation. In accordance with the invention, the threaded shaft 70 is not directly threadedly connected to the carriages 44, 45. Rather, there are provided drive nuts 71, 72 which have threaded engagement with the shaft 70 and which are connected to the respective carriages 44, 45 through a plurality of bolts 73 and compression springs 74. The springs 74 normally are precompressed so as to urge the carriages away from the drive nuts, in a transversely inward direction, until the bolt heads 75 are seated against the outer surfaces of the drive nuts.

For driving the threaded shaft 70, there is advantageously provided a stallable drive motor, such as a stall-torque electric motor or, more preferably, a low torque air motor 76. The air motor 76 is actuated by means of a reversing valve 77 and a variable pressure regulator valve 78. Thus, when the valve 77 is actuated to advance the edge drive roll carriages 44, 45 in a closing direction, it will continue to operate until the edge drive rolls have engaged the spreader frame 52 through the fabric walls, and the threaded shaft 70 has met with sufficient resistance to further rotation to cause the air motor 76 to stall out. The amount of torque resistance required to effect such stalling is controlled by the variable pressure regulator 78.

A substantial advantage is realized in actuating the carriages 44 or 45 through the compressible springs 74 rather than directly from the threaded shaft 70, in that inertia effects of the closing movement can be to a large extent absorbed by a slight amount of compression in the springs. Likewise, minor irregularities in the fabric can be accommodated between the spreader frame and the edge drive roll by slight compression of the springs, without significantly increasing the momentary edge pressure of the fabric. To even greater advantage, it is feasible to provide a great degree of operator control over fabric edge pressure by providing a calibrated indicating device to reflect the amount of compression in the springs 74. Thus, as shown in FIG. 5, the drive nut 71 may be provided with a series of calibrating marks 79 associated with a fixed mark 80 carried by an indicator bracket 81 extending from the carriage 44. When the edge drive rolls are advanced into position, the spring 74 will be compressed a predetermined amount before the motor 76 stalls out. The extent of the spring compression will be reflected by the relationship of the calibration marks 79, 80 and this will accurately reflect the amount of the edge pressure on the fabric. The machine operator may then easily adjust the pressure regulating valve 78 to achieve a desired degree of edge pressure as reflected by the calibrating marks.

On occasion, the incoming fabric 12 may tend to jam at the upper extremity of the spreader frame (as, for examaple, if the fabric were badly twisted or torn). In such cases, the driving forces on the fabric may dislodge the spreader frame with the potential of causing considerable damage to the equipment. This eventuality is effectively prevented by providing a safety limit switch 82, mounted on one of the carriages 45 (FIG. 4) by means of a suitable bracket 83. The safety switch 82 cooperates with an actuating arm 84 carried by the associated drive nut 72. One or both of the switch and actuating lever 82, 83 are positioned to provide for the switch to be in a "deactuated" condition during normal operations of the equipment. However, should the fabric 12 snag at the entry end of the spreader frame, dislodging the spreader frame, the edge drive roll cases will be moved quickly inward by the springs 74, causing the switch 82 to be actuated. By appropriate circuit arrangement (not shown but readily providable by persons skilled in the art) actuating of the safety switch 82 immediately shuts down the entire line for correction of the malfunction.

As will be appreciated, when the edge drive rolls 46 and 47 are withdrawn from the spreader frame, the frame will drop downward unless independently supported. Normally, the downstream extremity 85 of the spreader frame extends at least slightly between the rolls 86, 87 of the calendering stage, so that some support is provided for this end of the frame. For support of the upstream end of the frame, it is advantageous to provide a support bar 88 which is pivotally mounted on the machine frame by swing arms 89. Normally, the bar 88 rests in a position spaced below the spreader frame, to be out of contact with the fabric passing thereover. However, in preparation for separating the edge drive rolls and releasing the frame, the support bar 88 is swung to its upward position, shown in phantom lines in FIG. 1A, and secured by a latch 90.

To great advantage, the system of the present invention incorporates a new and improved steaming facility which is the subject of copending application Ser. No. 355,401, filed Apr. 30, 1973, entitled "High Production Steamer." This steamer, generally designated by the numeral 14 in FIG. 1A, is described in detail in said copending application and reference thereto may be made for supplemental information. In general, the steaming apparatus 14 includes a pair of dripless steam boxes 91, 92 extending transversely across the width of the fabric above and below the plane of the spreader 52. The construction of these steam boxes may be substantially in accordance with the S. Cohn, et al. U.S. Pat. No. 2,602,314, granted July 8, 1952.

Figure 6:
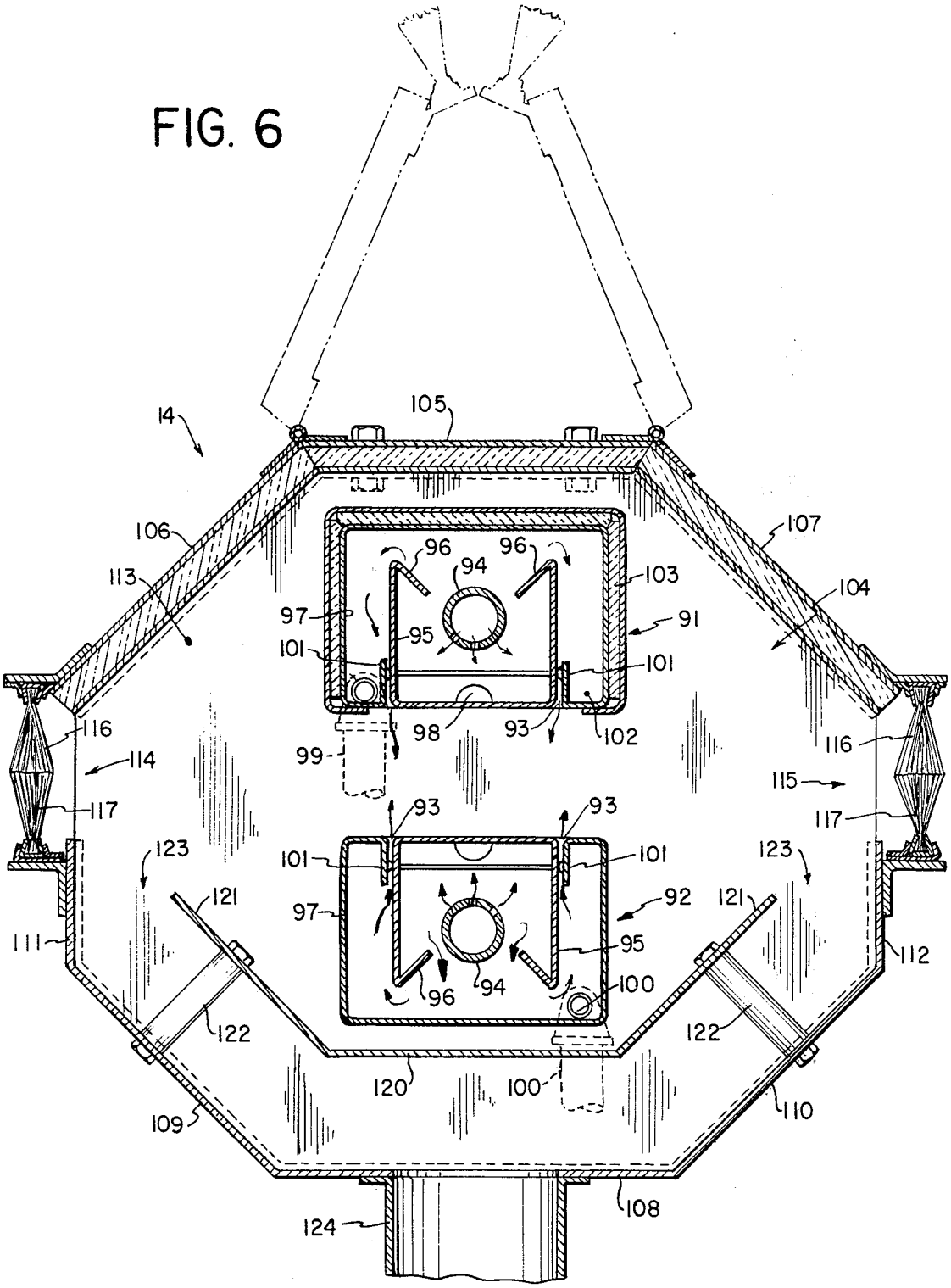
FIG. 6 is an enlarged, fragmentary cross-sectional view taken generally on line 6—6 of FIG. 3.

As reflected in FIG. 6, the steam boxes 91, 92 may be of similar construction, although reversely oriented, to provide pairs of transversely extending steam discharge slots 93. Perforated steam inlet pipes 94 extend across the width of the steam boxes and are arranged to discharge steam toward the closed side of a U-shaped channel 95. Flanged lips 96 of the channel extend toward the steam pipes and provide for the egress of steam into the main chamber of the steam box formed by an outer casing 97. In the case of the upper steam box 91, condensate is collected in the bottom of the channel 95, draining through an end opening 98 and eventually being extracted through an outlet pipe 99. In the case of the lower steam box, condensate is collected in troughs formed by the flange lips 96, enabling the condensate to be drained toward the ends of the steam box and eventually to be extracted through an outlet pipe 100. The outer housing 97 has flanged lips 101 which extend alongside the outer walls of the interior channel 95, to provide narrow, vertically extending slots 93 for the discharge of steam to the outside. The configuration of these slots 93 is such that steam condensate in the outer casing 97 of the upper box is collected in troughs 102 and eventually drained through outlet pipe 99.

The arrangement of the steam boxes is such as to enable steam to be discharged in full width jets across the width of the fabric both from above and from below the plane of the fabric. At the same time, condensate formed internally of the steam boxes is trapped and prevented from dripping on the fabric to cause spotting or staining. Desirably, at least the upper steam box 91 is provided with thermal insulation 103.

Although the steam boxes constructed in accordance with the beforementioned S. Cohn, et al. patent are highly efficient and effective in operation, the steaming operation has constituted a "bottleneck" of the finishing stage operations performed on tubular knitted fabric. In this respect, it is desirable to impart predetermined amounts of moisture to the fabric to enable the necessary fiber relaxation and readjustment to occur. With equipment heretofore utilized, efforts to increase the rate of production or increasing the rate of steam application beyond a predetermined level have been relatively ineffective, resulting either in non-uniform application of the steam, or in excessive problems from condensation and spotting, or both. In the system of the present invention, however, the fabric steaming facilities include significant improvements enabling the effective rate of steam to be greatly increased and production rates to be correspondingly increased, up to as much as two to four times the rates of production using conventional equipment.

The steam boxes 91, 92 are surrounded and substantially enclosed by a steam chamber 104. The chamber 104 includes an insulated upper wall 105 extending over the top of the upper steam box 91, and insulated upper side walls 106, 107 extending downward at an angle and terminating approximately at the level of the bottom of the steam box 91. The chamber also includes a bottom wall 108 disposed below the lower steam box 92, bottom side walls 109 and 110 extending upward at an angle from the bottom wall, and side wall extensions 111, 112 extending more or less vertically upward from the upper extremities of the bottom side walls and terminating approximately at the level of the top of the lower steam box 92.

End walls 113 connect the upper wall structure with the lower wall structure and form therewith a substantially totally enclosed steam chamber having narrow transverse openings 114, 115 to accommodate the spreader frame and the distended fabric being conveyed by the frame. Desirably, flexible seals 116, 117 are provided at the openings arranged to conform to the operatively positioned spreader frame to substantially close off the openings 114, 115 while permitting the free passage of the tubular knitted fabric through the chamber. Typically, the flexible seals may take the form of soft brushes or the like. In this respect, highly effective sealing is not a requirement of the elements 116, 117, but some closure facility is preferred to guide and confine the flow of steam and air within and about the chamber.

As will be readily apparent in FIGS. 1A and 3, the "width" dimension of the steam chamber 104 — that is in the longitudinal direction of fabric movement — is substantially less than the length of the spreader frame 52. In the illustrated system, the upstream-to-downstream dimension of the steam chamber is considerably less than the length of the second or downstream stage of the spreader frame, and is also considerably less than the transverse dimension or "length" of the chamber.

As reflected in FIG. 6, the steam chamber 104 includes a baffle plate 120, having a portion extending underneath the lower steam box 92, and flanges 121 extending upwardly and outwardly from the bottom portion. The baffle plate 120 is mounted by means of spacer posts 122 in spaced relation with the bottom wall 108 and bottom side walls 109, 110 of the steam chamber. The baffle plate 120 extends substantially to the end walls 113 of the steam chamber, but its flanges 121 are spaced away from the vertical side walls 111, 112 of the chamber so as to form large, transversely elongated passage openings 123 on opposite sides of the lower steam box 92.

An exhaust duct 124 is connected to the bottom wall 108 of the steam chamber so as to be in communication with the flow passage formed between the baffle 120 and the adjacent walls of the chamber. The exhaust duct is connected by suitable tubing 125 to the intake of an exhaust fan 126 arranged to direct the exhaust materials to an appropriate discharge point.

As will be understood from the illustration of FIG. 6, the exhaust duct 124 provides for a downdraft exhaust flow of the steam atmosphere contained in the chamber 104. Thus, steam issued in high velocity jets from the narrow openings 93 impinges directly on the fabric passing through the chamber, disperses into the chamber at large, and then is quickly drawn downwardly through the passages 123 and exhausted through the duct 124. This arrangement of conventional steam boxes, closely confined within a steam chamber of limited volume in relation to the steam boxes and provided with a highly effective exhaust facility, enables the rate of application of steam from the steam boxes to be greatly increased without undesirably affecting the processing operation. More importantly, it increases significantly the rate at which the fabric may be processed to a desired moisture content. Thus, high quality processing may be achieved at up to four times the rates possible with conventional apparatus.

Most advantageously, the capacity of the exhaust blower 126 is so related to the rate of input of steam into the chamber 104 as to maintain a substantially neutral to slightly positive pressure condition within the chamber, thereby preventing the escape of excessive amounts of steam from the chamber, while also preventing the inflow of undesirable amounts of fresh air.

After passing through the steam chamber 104, the fabric is directed through calendering rolls 86, 87, which may or may not be closed, depending upon the desired treatment to be imparted to the fabric. Where the fabric is to be calendered, the rolls 86, 87 are brought into closed, pressure-bearing relationship. To this end, the lower roll 87 may be journalled on a fixed axis in a bearing block 130, while the upper roll 86 may be journalled in a bearing block 131 arranged for vertical guided movement in a guide frame 132. To advantage, appropriate spring means (not shown) are provided for biasing the movable bearings 131 and the upper calender roll 86 to an upward or open position. The calender roll may be moved downwardly, in opposition to the biasing springs, by means of fluid actuators 133 at each side, controlled by a pressure regulator 134. Thus, any degree of operating pressure may be applied to the nip of rolls 86, 87 by appropriate adjustment of the pressure regulator 134. In the illustrated arrangement, the lower calendering roll 87 is driven directly by an electric drive motor 135, through a chain 136. The upper calendering roll 86 is driven in synchronism with the lower roller by means of idler pinions 137, 138 mounted on suitable linkages (not shown) or otherwise arranged to maintain a constantly meshing relationship while accommodating limited vertical movements of the upper roll 86.

The drive motor 135 for the calender rolls is speed adjustable relative to the main drive motor 51 for the edge drive rolls. Thus, as will be understood, any change in the speed of the edge drive rolls automatically will be reflected in the calender rolls, although the latter may be separately adjusted, typically to run at a controllably lower rate of speed than the edge five rolls, to accommodate the overfeeding of the fabric where desired.

At the discharge end of the equipment, there is provided a batching stand 140, which includes a roll-up batcher for the processed fabric, as well as fabric cutoff means and means for automatically or semi-automatically commencing the start of a new roll batch after fabric cutoff. To advantage, the batching stand may also include means for weighing the completed roll or batch, and also yardage counting means for recording the lengths of materials in the successive batches.

Figure 7:
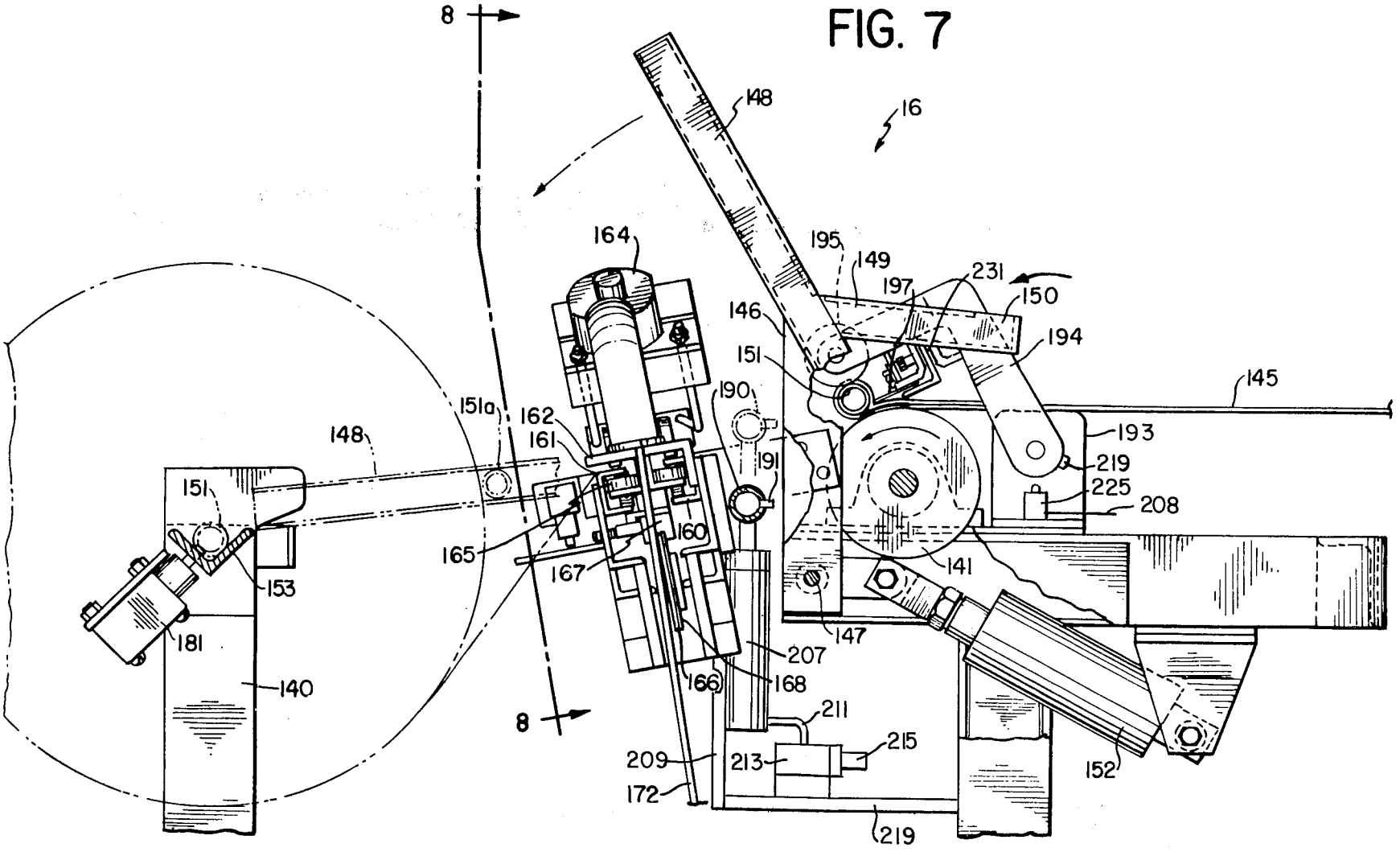
FIG. 7 is an enlarged, fragmentary view, partly in section, illustrating structural details of the discharge end of the apparatus of FIG. 1A–1B.
Figure 8:
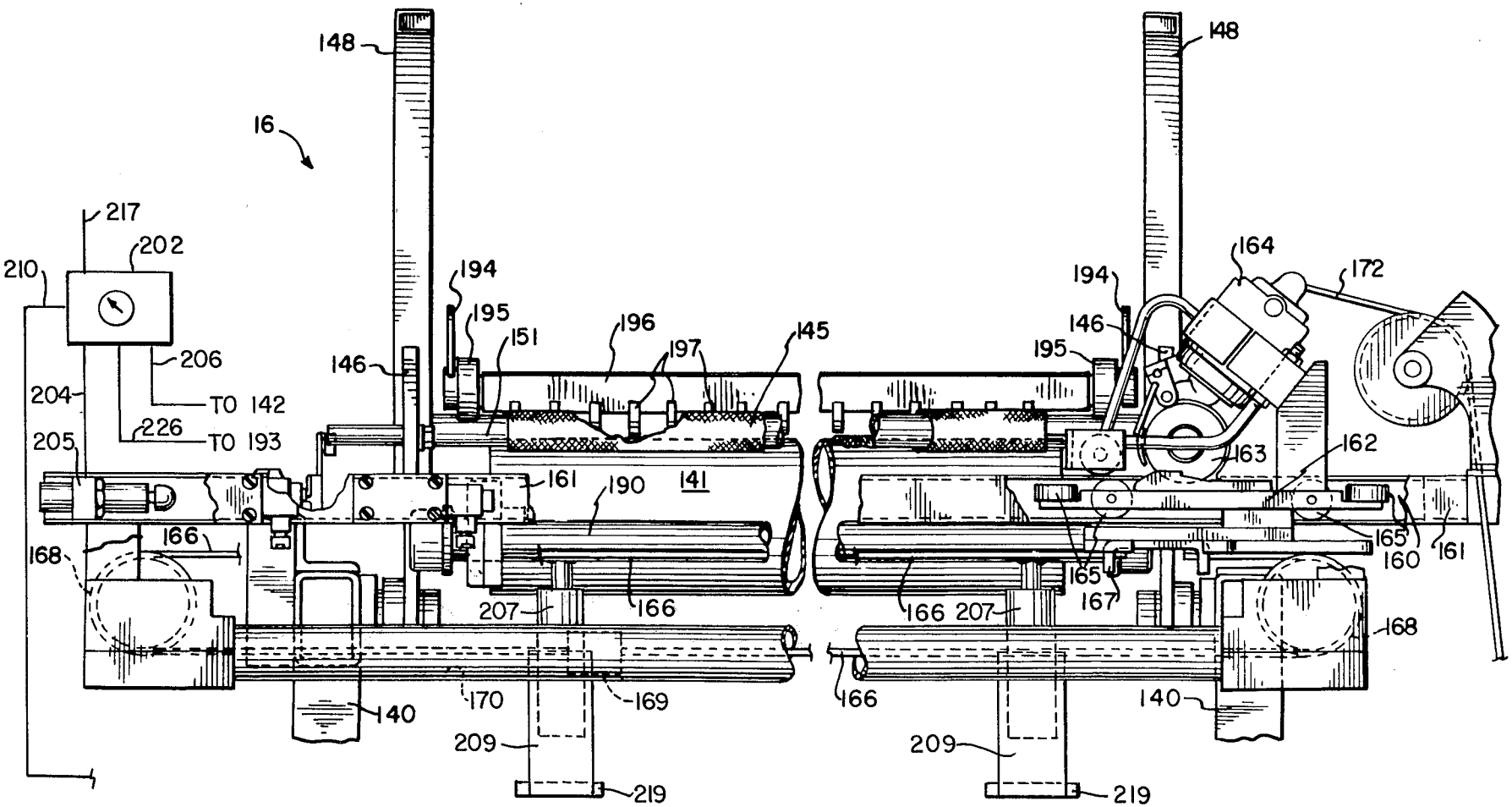
FIG. 8 is a fragmentary back elevational view of the apparatus of FIG. 1A–1B, as viewed generally at line 8—8 of FIG. 7.

Referring now to FIGS. 1A, 7 and 8, the batching stage includes a driven windup roller 141, which is journalled in the frame and is driven by a variable speed electric motor 142 by means of a chain 143 and suitable sprockets. The variable speed motor 142 is controllable in relation to the drive motor 135 for the calender rolls. Thus, as will be understood, any variation in calender roll speed automatically will be reflected by a corresponding speed change in windup roll motor 142. In addition, however, the motor 142 may be adjusted to operate at a certain percentage of speed above or below the speed of the calender drive motor 135. The arrangement typically is such that the fabric 145 extending berween the calendering stage 15 and the windup stage 16 is maintained under a very slight tension, sufficient to maintain the fabric under complete control without, however, introducing an excessive degree of longitudinal tension.

Pivotally mounted on the batching stand 140 is a support bracket 146, comprising a pair of support arms at each side of the machine, pivoted by a shaft 147 and secured together by suitable bracing (not shown) for movement in unison. The bracket 146 is operatively connected to a fluid actuator 152 for pivoting movement about an angle of almost 90°, from the position shown in full lines in 1A and 7, to the position shown in phantom lines in FIG. 7.

Secured to the bracket 146 are opposed pairs of mandrel guiding channels 148 and 149. The channels 148 constitute the principal mandrel guides, while the channels 149 form a reservoir for a new mandrel, being provided with an upwardly opening slot 150 in which a new mandrel may be placed during the winding of a roll of fabric on a previous mandrel. In operation, a mandrel 151 of appropriate length and diameter is received in the main guide channel 148 and arranged to bear against fabric resting on the driven winding roll 141. After starting of the windup operations, by means to be described, the accumulating roll forces the mandrel 151 radially away from the windup roll, urging it upward in the guide channels 148, until the desired roll size has been reached, as reflected in FIG. 1A. At that point, the actuator 152 is energized by means described below and extended to pivot bracket 146 in a counterclockwise direction, to a position in which the guide channels 148 are tilted slightly downward. The completed roll of fabric then readily rolls downhill, while still supported by the ends of the mandrel 151, until the mandrel ends drop into V-shaped receiving troughs 153 at the end of windup stand 140. When this pivoting action takes place, a new mandrel, held in the feeder channel 149, rolls down and enters the main guide channel 148 behind the fully wound fabric roll and rests there, as reflected at 151a in FIG. 7. When the bracket 146 subsequently is pivoted clockwise back to its normal position, the new mandrel 151a slides down the main guide channel 148, to rest directly on the fabric passing over winding roll 141.

In the apparatus of the invention, a cutoff facility is provided on the downstream side of the winding station. This comprises a pair of transversely extending, opposed guide channels 160, 161 (FIG. 8) which serve to support and guide for transverse movement a cutter carriage 162. The carriage mounts a rotary cutting knife 163 driven by an electric motor 164. The cutter carriage has a plurality of guide rollers 165 arranged to engage channels 160, 161 internally and accommodate the high speed travel of the cutter carriage across the full width of the machine. A drive cable 166 is connected to the carriage 162 by means of a bracket 167. The drive cable passes around pulleys 168 at each side of the machine and is connected to a moving piston element 169 within an elongated air actuator 170. When air is introduced into the left hand end of the actuator, as illustrated in FIG. 8, the cutter carriage is rapidly driven toward the left across the machine. When the cutter carriage engages a traverse limit switch 205 at the extremity of its movement, it energizes a carriage traverse timer 202. At the end of an adjustable delay period, as determined by timer 202, the air supply to the actuator 170 is reversed, and the cutter automatically returns to its starting position.

In this connection, timer 202 provides a sequence of signals through a plurality of lines connected thereto for the sequential control of a number of operations following cutoff and during the adjustable delay period of cutter carriage 162, as will be understood by practitioners in the art. Thus, after the predetermined adjustable dwell of cutter carriage 162 following its actuation of limit switch 205, timer 202 signals an appropriate solenoid through line 210 for admitting air to the left hand side of piston 169 for returning cutter carriage 162 to its starting position. Typically, the cutter motor 164 is electrically driven and, for this purpose, a retractable power cord 172 extends from an automatic rewind device 173 secured at the side of the windup frame 140.

In typical operation of the equipment, when a fabric roll has achieved the desired size, the machine operator stations himself at the discharge end of the machine (left hand end, as viewed in FIG. 1A) to prepare for the cutoff and restarting operations. When he desires to remove the completed roll, the operator actuates a foot switch 180, which is accessible from his station at the end of the machine. This causes a signal to be sent to a speed reduction control 221 as through line 222. Speed reduction control 221 is connected, in turn, to each of motors 142, 135 and 51 for selectively reducing speed or stopping the entire line momentarily for the web severing sequence to be described below. The actual connections between control 221 and each of the drive motors are not shown for clarity. At the same time, fluid actuators 152 are energized through connection (not shown) to foot switch 180 to pivot roll support brackets 146 in a counterclockwise direction to the position shown in phantom lines in FIG. 7. The fabric roll will then tend to travel down the path formed by the downwardly inclined guide channels 148, but typically this movement is expedited by the operator manually gripping the exposed ends of the mandred 151 (see FIG. 8) and drawing the completed roll toward the end of the machine. As the mandrel 151 reaches the end of the guide channel 148, it drops into the V-shaped receiving sockets 153 initiating further operations.

When the mandrel ends are in their receiving sockets, a switch 181 associated with one of the sockets is actuated. The fluid actuator 152 is thereby reversed to swing the brackets 146 and guide channels 148 clockwise back to their normal operating positions. After guide channels 148 have returned, and thus cleared the path of the cutter assembly 162–165, that movement trips a switch (not specifically illustrated) to energize traverse cylinder 170 and initiate a rapid cutting traverse of the cutter carriage. The tubular fabric will at this time be draped over the guide channels 160, 161, and the fabric thus will be severed by the cutter as it proceeds through its traverse, freeing the completed roll from the remainder of the fabric supply.

When the carriage reaches the end of its cutting stroke, it remains there as described above, until timer 202 times out and initiates a return movement. During the short "dwell" of the carriage between cutting and return strokes, the cut end of the fabric is flipped over and restarted as a new roll, as will appear.

In accordance with one aspect of the invention, the entire cutter apparatus, including the carriage 162, its guide channels 160, 161, and the related mechanisms is mounted on the arms of the pivotable bracket 146. As a result, when the bracket 146 is pivoted to discharge a wound roll, the entire cutter assembly pivots with the bracket and is thus temporarily retracted out of the way of the discharged roll. After the wound roll has been received in the sockets 153, the bracket 146 is pivoted back to its upright position, returning the cutter assembly to its operative position and orientation. By providing for the mementary pivotal retraction of the cutter assembly during roll discharge, it is possible to locate the cutting system and the cutting line much higher and much closer to the winding roll 141 than would be possible otherwise. This has the important advantage of reducing to a practical minimum the length of the "tail" of fabric which is to be flipped back over the new mandrel to start a new roll. By keeping this tail very short, greater reliability and uniformity is achieved in the restarting of rolls. In addition, the improved arrangement better accommodates the winding and handling of rolls of relatively large diameter.

Upon return of the guide channels 148 to their upright position, the new mandrel 151*a*, having previously rolled into the channel 148, now rolls down onto the winding roller 141, where it engages the layer of fabric extending over the winding roller in preparation for winding a new roll. In the following moments, the cutter carriage 162, as it completes its cutting traverse, trips limit switch 205 initiating a further sequence of operations through the action of timer control 202. Thus, timer 202 through line 208 signals solenoid 215 to actuate valve 213 admitting air under pressure to one end of a pair of reversible fluid actuated cylinders 207. Only one cylinder 207 is shown in FIG. 7, but it will be understood that there is one cylinder 207 at each side of the apparatus. Cylinders 207 are supported on verticle brackets 209 which are fixed on horizontal brace 219 which in turn, is fixed to the frame of the machine.

Thus, the upper end of the piston rod of each of cylinders 207, as viewed in FIG. 7, has an air manifold pipe 190 affixed thereto. Manifold 190 has an elongated horizontal discharge slot 191, which is directed rearwardly. By initiation of timer 202, solenoid 215 actuates cylinders 207 for raising manifold 190 to its upward position shown in phantom lines in FIG. 7. Because the tail end of the severed web 145 lies between cutter carriage 162 and windup roll 141, it is raised and partially folded backward by engagement with manifold 190. When air is supplied to this manifold 190 after it has reached its upper position and through a signal from timer control 202 the fabric is blown upwardly and rearwardly around the newly positioned mandrel 151, coming to rest on the upper surface of the fabric, on the upstream side of the mandrel 151 as reflected at 192 in FIG. 7. The duration of the raised position and the air supply to pipe 190 is controlled by timer 202.

In timed sequence with the action of manifold 190 above, a rotary actuator 193 is energized by timer 202 through line 226 to pivot, in a counterclockwise direction, a pair of tuck-in arms 194. These arms, which are of L-shaped configuration, carry positioning rollers 195 at their free ends, which are arranged to engage the end extremities of the newly positioned mandrel, to serve both as a position stop for the tuck-in arms 194 and momentarily to apply a controlled amount of pressure to the mandrel. Such momentary pressure helps to avoid slippage of the fabric on the driven winding roller 141 during the start up of a winding sequence when there is little or no inherent weight to the newly started roll.

Secured to the tuck-in arms 194, and extending across the width of the machine, is a tuck-in bar 196. The tuck-in bar has a plurality of resilient tucking fingers 197 so positioned that, when the arms 194 are actuated to their counterclockwise limit positions, the fingers engage the loose upper flap of fabric 192, in the region of the bight between mandrel 151 and winding roller 141, and cause a portion of the fabric to be tucked into this bight.

Tucking fingers 197 may be movably adjusted along bar 196 to accommodate different widths of fabric. Moreover, the holders therefore are reversible to provide different length fingers 197. The disclosure of this construction is detailed in my co-pending application Ser. no. 494,516, filed simultaneously herewith. The combination of this tucking, in cooperation with the controlled momentary pressure applied by positioning rollers 195, provides for controllably reliable restarting of the winding operation, after cutoff and doffing of a completed batch. The flip-over and tuck-in operations are normally initiated while the processing line remains in a stopped or slow speed condition. However, by an appropriately located limit switch 225 the counterclockwise movement of tuck-in arms 194 to operative positions serves to reactuate the processing line to resume its normal operating speed. That is, cam 219 on one of arms 294 engages switch 225 which, in turn, sends a signal through line 208 to speed controller 221 for re-instituting normal operating speed of the production line.

The clockwise or return movement of the tuck-in arms is controlled by timer 202 coinciding with the return of cutter carriage 162, and lowering of manifold 190 enabling the tuck-in operation to be reliably and effectively carried out, while at the same time withdrawing the tuck-in bar 196 before the newly winding roll undergoes a significant increase in diameter.

The completed roll batch, now resting in the sockets 153, may be removed and carried away during the interval of the winding of the next successive roll, as will be appreciated. When the filled mandrel 151 is received in the socket 153, it is also automatically weighed. The specific facility for registering the weight is not critical. To advantage, however, it may be an appropriate strain gauge or transducers element (not shown) which will sense the weight of the ends of mandrel 151 when resting in sockets 153.

The apparatus of the invention provides a highly improved form of apparatus for carrying out calendering and finishing operations on tubular knitted fabrics. While the finishing operations themselves are essentially conventional in a general sense, involving lateral distending, overfeeding (if desired) for lengthwise relaxation, steaming, calendering and batching, the manner in which these operations are accomplished with the apparatus of the invention results in important advantages including significantly increased production speeds. In particular, the processing speed of conventional steam finishing equipment has been inherently limited by the ability to carry out the steaming operation effectively. Thus, in the steaming operation a desired amount of moisture must be imparted to the fabric without causing water spotting or other blemishes on the fabric. Heretofore, efforts to increase production speeds by increasing the volume and/or velocity of steam application have not met with success, partly because the ability to impart moisture to the fabric does not appear to be simply a function of velocity or steam, and partly because of severe spotting problems from condensing moisture. With the system of the present invention, however, by effecting the application of steam to the fabric with steam jet means located within a confining chamber closely embracing and surrounding the steam outlet means, and continuously extracting excess steam from the enclosed chamber, the effective production rate of the steaming operation can be greatly increased relative to conventional speeds without compromising production quality standards.

The "upstream" portions of the new system may be utilized with various batching means, including folders. Nevertheless, the system of the invention incorporates to advantage improved yet simplified semi-automatic facilities for windup batching and doffing of the fabric, with a minimum of operator attention and with a minimum of discontinuity in the operation of the equipment. Thus, when the batch roll has reached the desired size, the operator initiates the doffing sequence by means of a simple foot switch control, after which roll removal, fabric cutoff, and restarting operations are carried out in a rapid, automatic sequence without further operator intervention. To this end, a novel mechanism is provided for tucking in the cutoff fabric end and for applying momentary starting pressure to the new mandrel for effectively reliable restarting of the windup. Once a few turns of fabric have been made upon the new mandrel, the rewinding will continue unaided, and the tuck-in element, the air jet manifold and the auxiliary pressure means may be quickly retracted.

It should be understood, of course, that the specific form of the invention herein illustrated and described is intended to be representative only, and any changes may be made therein without departing from the clear teachings of the disclosure. Accordingly, reference should be made to the following appended claims in determining the full scope of the invention.

I claim:

1. A semi-automatic batching and doffing means for winding fabric in batches, and of the type comprising a. a controllably driven winding roll for supporting and driving a roll of winding fabric, b. tiltable guide means for guiding the opposite ends of a fabric roll mandrel generally above said winding roll, c. transverse fabric cutoff means on the downstream side of the winding roll for severing the fabric web after completion of a roll, d. means for restarting the winding of a new roll; the improvement characterized by e. cutoff transverse limit sensing means, f. a vertically moveable air manifold means for vertically engaging and directing the cutoff end of the fabric web back and over a newly positioned winding mandrel; and g. timer control means connected to said vertically moveable air manifold means and said sensing means, to actuate the engagement of the cutoff end of the fabric web in response to engagement by said cutoff means of said sensing means.

2. The batching and doffing means of claim 1, further characterized by a. said traverse cutoff means including a pair of transverse guide channels receiving and guiding a cutter carriage, b. said traverse cutoff means additionally forming a fabric support for engagement and support of the fabric web during cutting thereof.

3. The batching and doffing means of claim 2, further characterized by a. said guide channels being positioned to lie closely adjacent the peripheral outlines of a fully wound fabric roll supported on said winding roll, whereby to minimize the free end length of the fabric following a cutting operation.

4. The batching and doffing means of claim 1, further characterized by a. said air manifold means including an elongated air manifold with a longitudinally extending horizontal slot for engaging the cutoff end of said fabric web with a substantially horizontal jet of impinging air.

5. A semi-automatic batching and doffing means for winding fabric in batches, and of the type comprising a. a controllably driven winding roll for supporting and driving a roll of winding fabric;

b. tiltable guide means for guiding the opposite ends of a fabric roll mandrel generally above said winding roll;

c. fabric cutoff means on the downstream side of the winding roll for severing the fabric web after completion of the roll; and d. means for restarting the winding of a new roll; the improvement characterized by e. said restarting means including vertically movable air jet means movable from a position out of engagement with the fabric web to a position engaging and raising the cutoff end of the fabric web;

f. time control means connected to said air jet means and responsive to said fabric cutoff means for causing sequentially the raising of said air jet means into engagement with the cutoff end of the fabric web, directing an impinging jet of air against said engaged cutoff end, and lowering of said air jet means.

6. The batching and doffing means of claim 5, in which a. said air jet means includes an elongated air manifold extending transversely of said fabric web;

b. a pair of spaced reversible fluid operated cylinders with one each connected at each end of said air manifold;

c. said air manifold having a horizontal elongated slot for emitting a substantially horizontal air jet transversely against the raised cutoff end of said fabric web.

* * * * *